US008413741B2

(12) United States Patent
Comarmond

(10) Patent No.: US 8,413,741 B2
(45) Date of Patent: Apr. 9, 2013

(54) HYDRAULIC ROTARY PERCUSSIVE DEVICE OF THE DRILL TYPE

(75) Inventor: Jean-Sylvain Comarmond, Vourles (FR)

(73) Assignee: Montabert, Saint Priest (FR)

( * ) Notice: Subject to any disclaimer, the term of this patent is extended or adjusted under 35 U.S.C. 154(b) by 0 days.

(21) Appl. No.: 12/226,263

(22) PCT Filed: Jun. 22, 2007

(86) PCT No.: PCT/FR2007/001038
§ 371 (c)(1),
(2), (4) Date: Jan. 23, 2009

(87) PCT Pub. No.: WO2007/147979
PCT Pub. Date: Dec. 27, 2007

(65) Prior Publication Data

US 2009/0159305 A1 Jun. 25, 2009

(30) Foreign Application Priority Data

Jun. 22, 2006 (FR) ..... 06 05609

(51) Int. Cl.
*B23B 47/04* (2006.01)

(52) U.S. Cl.
USPC ..... 173/105; 173/106

(58) Field of Classification Search ..... 173/90, 173/10, 105, 106, 110, 111, 201
See application file for complete search history.

(56) References Cited

U.S. PATENT DOCUMENTS

| | | | | |
|---|---|---|---|---|
| 1,605,712 | A | 11/1926 | Gilman | |
| 1,605,714 | A | 11/1926 | Gilman | |
| 1,703,842 | A * | 2/1929 | Gartin | 173/105 |
| 3,107,083 | A * | 10/1963 | Pewthers | 173/203 |
| 3,230,711 | A * | 1/1966 | Swain et al. | 60/371 |
| 3,747,694 | A * | 7/1973 | Kollandsrud | 173/137 |
| 3,918,531 | A * | 11/1975 | Amtsberg | 173/10 |
| 3,918,532 | A * | 11/1975 | Amtsberg | 173/105 |
| 4,103,746 | A * | 8/1978 | Reynolds | 173/107 |
| 4,192,393 | A * | 3/1980 | Womack et al. | 175/103 |
| 4,366,868 | A * | 1/1983 | Salmi | 173/105 |
| 4,478,248 | A * | 10/1984 | DeVall et al. | 137/624.13 |
| 4,585,080 | A * | 4/1986 | Bender | 175/170 |
| 4,702,325 | A * | 10/1987 | Hipp | 173/64 |
| 5,199,151 | A * | 4/1993 | Wentworth et al. | 29/437 |
| 5,437,338 | A * | 8/1995 | Martin et al. | 173/47 |
| 5,667,022 | A * | 9/1997 | Gude | 173/105 |

FOREIGN PATENT DOCUMENTS

| | | |
|---|---|---|
| CH | 90832 | 10/1921 |
| CH | 338419 | 5/1959 |
| DE | 449 946 | 9/1927 |
| FR | 2 364 325 | 4/1978 |

* cited by examiner

*Primary Examiner* — M. Alexandra Elve
*Assistant Examiner* — Nathaniel Chukwurah
(74) *Attorney, Agent, or Firm* — Oliff & Berridge, PLC

(57) ABSTRACT

The invention relates to a hydraulic rotary percussive device of the drill type, intended for drilling boreholes, comprising: a striking mechanism equipped with a piston which is able to move translationally along a striking axis and is intended to strike a tool; a hydraulic motor which rotates the tool about an axis of rotation, the axis of rotation of the motor being substantially coincident with the striking axis of the piston, wherein it comprises a support-forming casing, the striking mechanism being hydraulic and having a longitudinal body rotatably mounted in the casing about the axis of the body, the body being rotated directly by the motor and coupled to the tool.

8 Claims, 1 Drawing Sheet

HYDRAULIC ROTARY PERCUSSIVE DEVICE OF THE DRILL TYPE

BACKGROUND OF THE INVENTION AND DESCRIPTION OF THE PRIOR ART

The invention relates to a hydraulic rotary percussive device of the drill type, for drilling boreholes.

Drills are used for a variety of applications, such as excavating quarries, tunnels or mines.

These devices are composed of a carrying machine known as a "carrier", on which is located a slide which holds a rotary percussive device of the drill type.

The drill generally consists of a percussion mechanism and a rotating mechanism. When the latter is installed on the carrier, it receives hydraulic power and transforms it into percussive and rotary mechanical power in order to create boreholes using a boring bar and a drilling bit in contact with the rock.

The percussion mechanism is generally rigidly mounted in the casing of the rotary percussive device whereas the rotating mechanism, comprising a motor mounted laterally on a shaft parallel to that of the percussion mechanism, rotates the shank of the boring bar by way of reduction pinions.

This shank is therefore made to rotate and receives the impacts caused by the piston of the percussion mechanism.

The drawback of this conventional solution is the high cost of the device caused by the presence of pinions which are expensive components requiring, in order to be installed in the device, costly mechanical equipment.

The document CH338419 describes a rotary percussive device comprising:

- a percussion mechanism equipped with a piston able to undergo translational movement along a percussion axis and intended to strike a bit, and
- a motor rotating the bit about a rotational axis more or less coinciding with the percussion axis of the piston.

The percussion mechanism is attached to the rear surface of the motor casing.

This juxtaposition of casing and percussion mechanism gives the rotary percussive device a large size and a complex structure.

According to one embodiment, the motor is pneumatic. In this case, it is necessary for pinions to be provided. This gives the device a high cost.

SUMMARY OF THE INVENTION

The invention aims to alleviate these drawbacks by providing a compact rotary percussive device of simple structure, which has a lower manufacturing cost.

To this end, the invention relates to a hydraulic rotary percussive device of the drill type, for drilling boreholes, comprising:

- a percussion mechanism equipped with a piston able to undergo translational movement along a percussion axis and intended to strike a bit,
- a hydraulic motor rotating the bit about a rotational axis, the rotational axis of the motor more or less coinciding with the percussion axis of the piston,
- characterized in that it has a support-forming casing, the percussion mechanism being hydraulic and comprising a longitudinal body mounted rotatably in the casing about the axis of the body, the body being rotated directly by the motor and being coupled to the bit.

Such an apparatus therefore requires no pinions or any other system to be present, since the rotational axis is more or less coincident with the axis of the percussion mechanism.

Advantageously, the hydraulic motor is connected to two fluid supply lines and the percussion mechanism is supplied with fluid by an inlet duct and an outlet duct which are connected respectively to a high-pressure supply and a low-pressure supply.

Preferably, the bit is coupled to one end of the body.

According to a first embodiment of the invention, the body is coupled to an output shaft of the motor at its end.

According to a second embodiment, the motor has a hollow shaft.

According to a feature relating to the second embodiment, part of the body rotates as one with the hollow shaft of the motor.

BRIEF DESCRIPTION OF THE DRAWINGS

The invention will be better understood with the aid of the following description, with reference to the attached schematic drawing, which shows by way of nonlimiting example a plurality of embodiments of this rotary percussive device.

DESCRIPTION OF THE PREFERRED EMBODIMENTS

Figure 1:
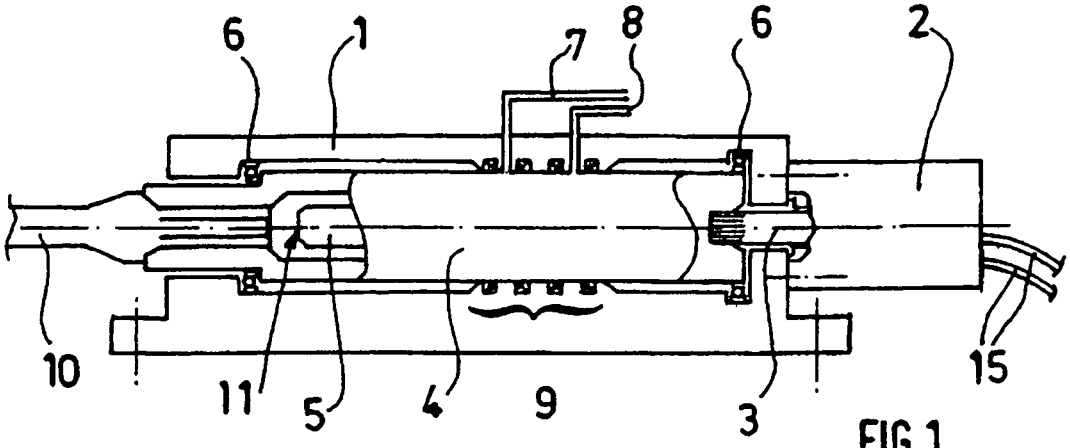
FIG. 1 is a partial longitudinal sectional view of a rotary percussive device according to a first embodiment of the invention.

FIG. 1 describes a first embodiment of the invention. The rotary percussive device, namely a drill, has a casing 1 equipped with a hydraulic motor 2 to which two supply lines 15 are connected. The hydraulic motor 2 is located at the rear of the drill and has an output shaft 3.

The drill further has a hydraulic percussion mechanism comprising a substantially cylindrical body 4, inside which a percussion piston 5 is mounted such that it can undergo translational movement along the axis of the body 4.

The body 4 is coupled to the output shaft 3 of the hydraulic motor 2 at a first end at which a central housing is provided.

The coupling is carried out by way of a direct coaxial drive, for example of the splined shaft and housing type or the elastic coupling type.

The axis of the body 4 thus coincides with the rotational axis of the motor 2, the piston 5 being disposed such that the percussion axis, i.e. the translational axis of the piston 5 on which the impact point is located, namely the point at which the resultant of the forces applied by the piston on the bit is exerted, coincides with the rotational axis of the motor 2.

The rotation of the motor 2 is provided by bearings or rolling bearings 6 mounted between the casing 1 and the body 4.

The percussion apparatus further has a conventional directional control valve for reciprocating the piston 5.

The fluid is thus fed to the percussion apparatus via an inlet duct 7 and an outlet duct 8 which are connected respectively to the high-pressure supply and the low-pressure supply.

A number of rotary seals 9 provided between the body 4 and the casing 1 isolate the assembly.

The body 4 of the percussion apparatus also has, at a second end opposite the driving end, a housing for fitting a drill bit 10.

This fitting takes place, for example, by matching the shapes by way of facets and/or splines.

In a manner known per se, the housing opens onto the percussion surface 11 of the piston 5 so that the bit 10 can be struck by the piston.

Thus, while the drill is being used, the hydraulic motor 2 rotates the bit 10 via the body 4 of the percussion mechanism, the piston 5 also striking the bit 10 as it moves back and forth.

Figure 2:
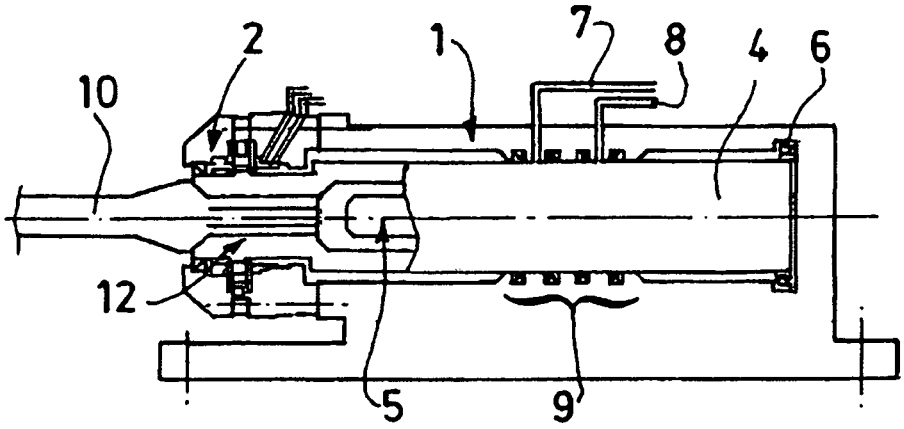
FIG. 2 is view corresponding to FIG. 1 of another embodiment of the invention.

FIG. 2 describes a second embodiment of the invention in which the same elements are provided with the same reference numerals as before.

In this embodiment, the hydraulic motor 2 has a hollow shaft and is disposed at the end where the bit 10 is fitted.

At this end, the body has a drive zone 12 having a diameter smaller than that of the body 4.

This drive zone 12, the outside diameter of which corresponds more or less to the inside diameter of the hollow shaft of the motor 2, is disposed in the latter such that the rotational axis of the body 4 coincides with the percussion axis of the piston 5.

The operation of the percussion apparatus and the fitting of the bit into the body are similar to the first embodiment of the invention.

The two embodiments shown thus define a low-cost percussion device of simple design.

Obviously, the invention is not limited to just the embodiments of this system that have been described above by way of example, but also includes any variants thereof.

The invention claimed is:

1. A hydraulic rotary percussive device of the drill type, for drilling boreholes, comprising:

a support-forming casing;

a hydraulic percussion mechanism equipped with a piston configured to undergo translational movement along a percussion axis and intended to strike a bit, the percussion mechanism comprising a longitudinal body mounted rotatably in the casing about an axis of the body, the entire piston being mounted inside the body, and the bit being directly coupled to one end of the body; and a hydraulic motor rotating the bit about a rotational axis, the rotational axis of the motor more or less coinciding with the percussion axis of the piston;

wherein, the body is rotated directly by the motor and the bit is rotated directly by the body.

2. The rotary percussive device as claimed in claim 1, wherein the hydraulic motor is connected to two fluid supply lines and the percussion mechanism is supplied with fluid by an inlet duct and an outlet duct which are connected respectively to a high-pressure supply and a low-pressure supply.

3. The rotary percussive device as claimed in claim 2, wherein the body is coupled to an output shaft of the motor at one end of the body.

4. The rotary percussive device as claimed in claim 2, wherein the motor has a hollow shaft.

5. The rotary percussive device as claimed in claim 4, wherein part of the body rotates as one with the hollow shaft of the motor.

6. The rotary percussive device as claimed in claim 1, wherein the body is coupled to an output shaft of the motor at one end of the body.

7. The rotary percussive device as claimed in claim 1, wherein the motor has a hollow shaft.

8. The rotary percussive device as claimed in claim 7, wherein part of the body rotates as one with the hollow shaft of the motor.

* * * * *

UNITED STATES PATENT AND TRADEMARK OFFICE

CERTIFICATE OF CORRECTION

PATENT NO. : 8,413,741 B2
APPLICATION NO. : 12/226263
DATED : April 9, 2013
INVENTOR(S) : Jean-Sylvan Comarmond It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 644 days.

Signed and Sealed this
Thirteenth Day of August, 2013

Teresa Stanek Rea
*Acting Director of the United States Patent and Trademark Office*